US009573074B2

(12) United States Patent
Ryaa

(10) Patent No.: US 9,573,074 B2
(45) Date of Patent: Feb. 21, 2017

(54) TOY BUILDING SET

(75) Inventor: Jan Ryaa, Billund (DK)

(73) Assignee: LEGO A/S, Billund (DK)

( * ) Notice: Subject to any disclaimer, the term of this patent is extended or adjusted under 35 U.S.C. 154(b) by 52 days.

(21) Appl. No.: 13/880,591

(22) PCT Filed: Oct. 18, 2011

(86) PCT No.: PCT/DK2011/050392

§ 371 (c)(1),
(2), (4) Date: Aug. 22, 2013

(87) PCT Pub. No.: WO2012/052026

PCT Pub. Date: Apr. 26, 2012

(65) Prior Publication Data

US 2013/0330997 A1 Dec. 12, 2013

(30) Foreign Application Priority Data

Oct. 21, 2010 (DK) ..... 2010 00955

(51) Int. Cl.
*A63H 33/12* (2006.01)
*A63H 33/04* (2006.01)

(52) U.S. Cl.
CPC ..... *A63H 33/04* (2013.01); *A63H 33/042* (2013.01)

(58) Field of Classification Search
CPC ..... A63H 33/04; A63H 33/042
(Continued)

(56) References Cited

U.S. PATENT DOCUMENTS 2,423,002 A 6/1947 Bray
2,575,054 A 11/1951 Gowdy
(Continued)

FOREIGN PATENT DOCUMENTS

CH 389481 A 3/1965
CN 85101526 A 1/1987
(Continued)

OTHER PUBLICATIONS

International Search Report for corresponding international application No. PCT/DK2011/050392, mailed on Feb. 22, 2012.
(Continued)

*Primary Examiner* — Melba Bumgarner
*Assistant Examiner* — Joseph B Baldori
(74) *Attorney, Agent, or Firm* — Day Pitney LLP

(57) ABSTRACT

A toy building element comprising at least one first type of building element (1), on which a rotation shaft (3) located along an axis of rotation is arranged, and wherein the toy building set comprises at least one second type (6) of building element in which a rotation bushing (9) is provided which is configured for receiving and being interconnected with the rotation shaft on the first building element in such a manner that the two building elements can rotate relative to each other about the axis of rotation. At least two separate ribs are configured on the rotation shaft on the first type of building element, and the second type of building element comprises a ratchet mechanism (7) configured such that, when the two types of building elements are interconnected by means of the snap connection, the ratchet mechanism cooperates with the ribs (5) on the rotation shaft to the effect that a ratchet sound is generated when the two types of building elements are rotated relative to each other about the axis of rotation.

5 Claims, 1 Drawing Sheet

Figure 1:
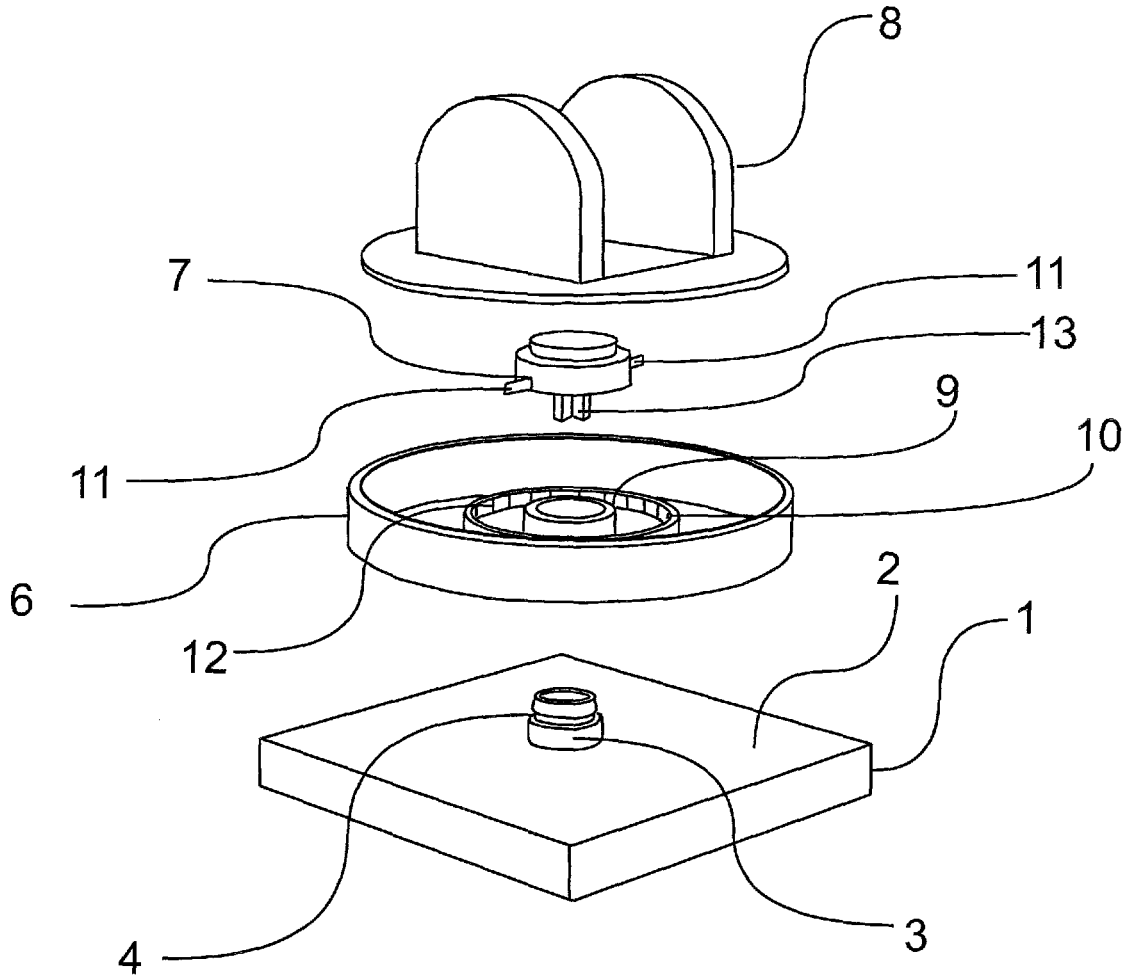

(58) Field of Classification Search
USPC ..... 446/85, 102, 120
See application file for complete search history.

(56) References Cited

U.S. PATENT DOCUMENTS

| | | | | | |
|---|---|---|---|---|---|
| 2,649,803 | A | | 8/1953 | Andre | |
| 3,233,358 | A | * | 2/1966 | Dehm | 446/102 |
| 3,236,004 | A | * | 2/1966 | Christiansen | 446/102 |
| 3,324,619 | A | | 6/1967 | Gearhart | |
| 3,415,155 | A | | 12/1968 | Riddell et al. | |
| 3,425,314 | A | | 2/1969 | Ohlson | |
| 3,510,979 | A | * | 5/1970 | Fischer | 446/102 |
| 3,513,588 | A | * | 5/1970 | Fischer | 446/127 |
| 3,553,882 | A | * | 1/1971 | Meates | 446/102 |
| 3,713,248 | A | * | 1/1973 | Heubl | 446/102 |
| 4,037,978 | A | | 7/1977 | Connelly | |
| 4,124,949 | A | * | 11/1978 | Bach et al. | 446/104 |
| 4,176,493 | A | * | 12/1979 | Dideriksen | 446/102 |
| 4,176,582 | A | * | 12/1979 | Witte | 411/7 |
| 4,375,139 | A | * | 3/1983 | Chatani | 446/471 |
| 4,506,408 | A | * | 3/1985 | Brown | 16/225 |
| 4,551,110 | A | | 11/1985 | Selvage et al. | |
| 4,604,073 | A | | 8/1986 | Livesey et al. | |
| 4,604,973 | A | | 8/1986 | Hayashi | |
| 4,740,189 | A | * | 4/1988 | Bertrand | 446/128 |
| 4,764,144 | A | | 8/1988 | Lyman | |
| 4,947,527 | A | | 8/1990 | Hennig | |
| 5,049,104 | A | * | 9/1991 | Olsen | 446/104 |
| 5,360,364 | A | * | 11/1994 | Poulsen et al. | 446/102 |
| 5,427,558 | A | * | 6/1995 | Knudsen et al. | 446/102 |
| 5,503,497 | A | * | 4/1996 | Dudley et al. | 403/103 |
| 5,538,452 | A | * | 7/1996 | Kurani | 446/102 |
| 5,582,488 | A | * | 12/1996 | Dudley et al. | 403/103 |
| 5,600,870 | A | * | 2/1997 | Fields et al. | 16/342 |
| 5,769,681 | A | | 6/1998 | Greenwood, Sr. et al. | |
| 5,779,515 | A | * | 7/1998 | Chung | 446/90 |
| 6,030,270 | A | * | 2/2000 | Krog | 446/102 |
| 6,461,215 | B1 | * | 10/2002 | Kunz et al. | 446/107 |
| 6,491,567 | B2 | * | 12/2002 | Chan | 446/478 |
| 6,540,461 | B1 | * | 4/2003 | Hawang | 411/48 |
| 6,595,825 | B1 | * | 7/2003 | De Wilde | 446/102 |
| 6,736,691 | B1 | * | 5/2004 | Bach | 446/128 |
| 7,175,501 | B2 | * | 2/2007 | Choi | 446/468 |
| 7,736,211 | B2 | * | 6/2010 | Marzetta | 446/122 |
| 8,047,890 | B1 | * | 11/2011 | Haas | 446/124 |
| 8,157,470 | B2 | * | 4/2012 | De Wilde | 403/348 |
| 8,888,552 | B2 | * | 11/2014 | Wizenberg et al. | 446/102 |
| 2006/0264147 | A1 | * | 11/2006 | Shoptaugh | 446/120 |
| 2007/0277459 | A1 | | 12/2007 | Marzetta | |
| 2008/0175656 | A1 | | 7/2008 | Blattner et al. | |
| 2010/0210173 | A1 | | 8/2010 | Maggiore et al. | |
| 2013/0084767 | A1 | * | 4/2013 | McDonald | 446/102 |
| 2013/0316610 | A1 | * | 11/2013 | Maddocks et al. | 446/90 |

FOREIGN PATENT DOCUMENTS

| | | | |
|---|---|---|---|
| CN | 201220122 | Y | 4/2009 |
| EP | 1099460 | A2 | 5/2001 |
| EP | 1149618 | A2 | 10/2001 |
| FR | 1198239 | A | 12/1959 |
| GB | 553918 | A | 6/1943 |
| GB | 634468 | A | 3/1950 |
| GB | 1314965 | A | 3/1973 |
| GB | 2426213 | A | 11/2006 |
| JP | S51-45320 | | 4/1976 |
| JP | S59-159497 | U | 10/1984 |
| JP | H02063897 | U | 5/1990 |
| JP | H04503618 | A | 7/1992 |
| JP | 7-55266 | B2 | 6/1995 |
| JP | 3069452 | U | 3/2000 |
| JP | 2003-508138 | A | 3/2003 |
| JP | 2007050064 | A | 3/2007 |
| JP | 2008020063 | A | 1/2008 |
| JP | 2009100882 | A | 5/2009 |
| WO | 93/22018 | A1 | 11/1993 |

OTHER PUBLICATIONS

Office Action issued from the Danish Patent and Trademark Office, for priority application DK PA 2010 00955, mailed on May 12, 2011 together with list of relevant documents, dated May 10, 2011. (in the Danish language).

International-Type Search Report issued from the International Searching Authority, for priority application DK PA 2010 00955, mailed Mar. 9, 2011.

International Search Report for co-pending international application PCT/DK2011/050391, mailed Feb. 23, 2012.

Written Opinion of the International Searching Authority for co-pending international application PCT/DK2011/050391, Apr. 23, 2015.

International-Type Search Report issued from the Danish Patent and Trademark Office for priority application PA 2010 00953, Apr. 29, 2011.

USPTO's Non-Final Office Action issued in related U.S. Appl. No. 13/880,014, Aug. 18, 2016.

USPTO's Final Office Action issued in related U.S. Appl. No. 13/880,014, Dec. 4, 2015.

Notification of Reasons for Refusal issued in related Japanese patent application No. 2013-534166, Nov. 24, 2015 (with computer-generated English translation).

Notification of Reasons for Refusal issued in related Japanese patent application No. 2013-534167, Dec. 1, 2015 (with computer-generated English translation).

Notification of Reasons for Refusal issued in related Japanese patent application No. 2013-534166, Oct. 6, 2016 (with computer-generated English translation).

USPTO's Non-Final Office Action issued in related U.S. Appl. No. 13/880,014, Mar. 12, 2015.

* cited by examiner

TOY BUILDING SET

CROSS-REFERENCE TO RELATED APPLICATIONS

This application is the U.S. National Stage of International Application No. PCT/DK2011/050392, filed on Oct. 18, 2011, and published on Apr. 26, 2012 as WO 2012/052026, which claims the benefit of priority to Danish Patent Application Serial No. PA 2010 00955, filed on Oct. 21, 2010.

FIELD OF APPLICATION OF THE INVENTION

The present invention relates to a toy building set comprising at least one first building element, on which a rotation shaft located along an axis of rotation is arranged, and wherein the toy building set comprises at least one second building element in which a rotation bushing is provided which is configured for receiving and being interconnected with the rotation shaft on the first building element in such a manner that the two building elements can rotate relative to each other about the axis of rotation; and wherein, at the rotation shaft and the rotation bushing, respectively, complementary coupling means are configured for forming a snap connection for interconnection of the rotation shaft and the rotation bushing in such a manner that they cannot be interconnected with or disconnected from each other along the axis of rotation without the snap function being activated by a given force impact along the axis of rotation.

STATE OF THE ART

Toy building sets of the kind set forth above are known in various embodiments, wherein the first and the second type of building element are used for building a turntable function which can be used for a wide variety of purposes when used during the building of a construction consisting of other toy building elements or toy building blocks.

It is a problem of those prior art turntables that their function is the same irrespective of the construction they partake in, and, hence, that it is not possible to build turntable functions that are dedicated to a specific purpose.

Therefore, other types of toy building sets are known that comprise various pre-assembled turntables that are mounted by the manufacturer and which are designed with a specific purpose to the effect that those turntables are dedicated to the individual purpose.

OBJECT OF THE INVENTION

Based on this, it is the object of the present invention to provide a toy building set of the kind described above, whereby it is possible, by means of relatively few individual components, to construct a wider range of different constructions.

This is accomplished in that at least two separate ribs are configured on the rotation shaft on the first type of building element, and in that the second type of building element comprises a ratchet mechanism configured such that, when the two types of building elements are interconnected by means of the snap connection, the ratchet mechanism cooperates with the ribs on the rotation shaft to the effect that a ratchet sound and force are generated when the two types of building elements are rotated relative to each other about the axis of rotation.

It being hereby possible to use one single embodiment of the first type of building element, and then, optionally—based on one's wish to build a specific type of turntable—to interconnect it with different embodiments of the second type of building element, better options for providing variation are hereby accomplished by means of relatively few constituent components.

Moreover, it is known from WO 9322018 to use snap connections on coupling studs in a toy building set that allow two building elements to be rotated relative to each other when they are interconnected by means of a coupling stud only.

According to one embodiment of the invention, the complementary coupling means on the first and the second type of toy building element comprise a groove extending into the outer side of and all the way around on the rotation shaft on the first type of toy building element, and one or more ribs are arranged on the inner side of the rotation bushing in such a way that each of the ribs engages with the groove when the two building elements are interconnected by means of the snap connection.

Advantageously, the first type of building element may have an essentially plane surface from where the rotation shaft protrudes substantially at right angles, and wherein the rotation shaft is configured as a tube on which the ribs are arranged on the inner side of the tube.

According to a preferred embodiment, the second type of building element may itself constitute a ratchet, the rotation bushing on the second type of building element comprising a tube which, upon interconnection of the two types of building elements, extends on the outer side of the rotation shaft on the first type of building element, and wherein the ratchet mechanism comprises a ratchet element which is mounted rotatably in the tube on the second type of building element in such a way that the ratchet element is capable of engaging with the ribs on the inner side of the rotation shaft to the effect that the ratchet element is, when the two types of building elements are interconnected by means of the snap connection, forced to rotate along with the first type of building element.

In this context, the second type of building element may advantageously comprise a ratchet housing on which the rotation bushing forms an integral part, and wherein, in the ratchet housing, a set of ratchet ribs is configured which ribs are arranged in a circle around the rotation bushing, and wherein, on the ratchet element, a number of elastic ratchet springs are configured that will, when the ratchet element is rotated in the ratchet housing, be driven past the ratchet ribs in the ratchet housing, whereby the ratchet springs are successively deformed elastically against the ratchet ribs to the effect that a ratchet sound is generated. Hereby it is accomplished that most of the constituent components that constitute the second type of building element may be the same, and that the ratchet function as such, i.e. the ratchet sound, and the force it takes to drive the ratchet mechanism around can be modified merely by providing a different configuration of the ratchet element.

Moreover, toy building sets may comprise a third type of building element which has a rotation bushing essentially corresponding to the rotation bushing on the second type of building element, but wherein no ratchet mechanism is provided.

It is particularly advantageous if the ratchet ribs and the ratchet springs are configured within a closed space in the ratchet housing, as they are hereby being safeguarded against them being destroyed, to the effect that they maintain the intended ratchet function for as long as possible.

In the context of this, the ratchet housing may advantageously comprise a dish-shaped part in which the rotation bushing is configured at the bottom of the dish-shaped part to the effect that the dish-shaped part has an opening arranged opposite the rotation bushing, and wherein a separate lid part is configured that covers the opening of the dish-shaped part to the effect that the dish-shaped part and the lid form a substantially closed space from where the ratchet element extends outwards through the rotation bushing. Hereby it is rendered possible to use different lid parts on the same dish-shaped portion to the effect that the lid part is configured for specific purposes corresponding to the ratchet function integrated into the ratchet housing.

LIST OF FIGURES

FIG. 1: is an exploded view showing an embodiment of the invention, seen in an inclined view from above.

Figure 2:
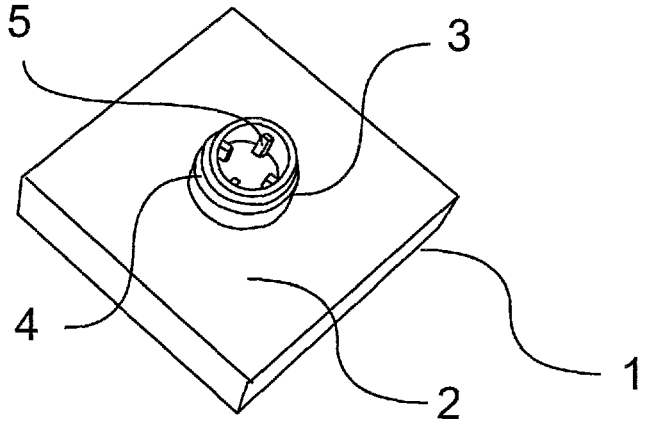

FIG. 2: depicts another embodiment of one of the constituent components according to FIG. 1, seen in an inclined view from above.

EMBODIMENT OF THE INVENTION

Thus, FIG. 1 shows a turntable according to the present invention in the form of an exploded view showing the first type of building element 1 which has an essentially plane surface 2 on which an essentially circular cylindrical rotation shaft 3 is provided which has, on its outer side, a round-going groove 4 extending continuously all the way around the rotation shaft 3.

FIG. 2 shows the first type of building element 1 which corresponds, in principle, to that which is shown in FIG. 1, but wherein a number of ribs 5 are shown (herein only two of four are fully visible), arranged on the inner side of the rotation shaft 3, said rotation shaft 3 being configured as a tube with a central hole.

Above the first type of building element, FIG. 1 shows a second type of building element in the form of a ratchet housing 6, a ratchet element 7, and a lid 8.

Herein, the ratchet housing 6 is configured substantially as a circular cylindrical dish which has, centrally thereof, a rotation bushing 9 which is configured for receiving the rotation shaft 3 on the first building element 1 to the effect that, upon reception, a turntable is formed, said rotation shaft 3 and said rotation bushing 9 allowing the first building element 1 and the second building element 6 to rotate about an axis of rotation defined by the axis of symmetry of the circular cylindrical rotation shaft 3.

According to a preferred embodiment, a (not shown) rib is arranged on the inner side of the rotation bushing 9 which can be caused to engage with the round-going groove 4 on the rotation shaft 3. Thereby a snap connection is provided between the first type of building element 1 and the second type of building element 6, it being thereby possible to press the second type of building element from the position shown in the drawing down onto the first type of building element, following which they can rotate relative to each other only about the axis of rotation.

Across the rotation bushing 9, a ratchet element is arranged which is provided on each side with a ratchet spring 11. On the underside of the ratchet, and in the direction of the rotation shaft 3, a multi-groove 3 is provided having, in the shown embodiment, a total of four grooves. And just the same as when the ratchet element 7 is lowered onto the rotation bushing 9, it extends through the rotation bushing 9 and down into the central hole in the rotation shaft 3, where the multi-groove 13 engages with the four ribs 5 on the inner side of the tubular rotation shaft 3.

Hereby it is accomplished that, when the first building element is rotated about the axis of rotation relative to the dish 6 in the second type of building element, the ratchet element 7 will rotate along with the first building element, and thereby the two ratchet springs 11 will be forced to abut elastically on the circular cylindrical flange 10 provided with ribs 12 and which is arranged within the dish, and facing the rotation bushing 9 on the second building element 6. The two ratchet springs 11 being thus forced to brush across the ribs 12 that are arranged on the inner side of the flange 10, a ratchet function will thereby be established.

To safeguard against it being possible to unintentionally destroy the ratchet function, a lid 8 is provided above the second building element 6, said lid being attachable to the dish to the effect that it forms, along with the dish, a closed space on the ratchet housing.

The invention claimed is:

1. A toy building set comprising at least one first type of building element, on which a rotation shaft located along an axis of rotation is arranged, and wherein the toy building set comprises at least one second type of building element in which a rotation bushing is provided which is configured for receiving and being interconnected with the rotation shaft on the first building element in such a manner that the two building elements can rotate relative to each other about the axis of rotation; and wherein, at the rotation shaft and the rotation bushing, respectively, complementary coupling means are configured for forming a snap connection for interconnection of the rotation shaft and the rotation bushing in such a manner that they cannot be interconnected with or disconnected from each other along the axis of rotation without the snap connection being activated along the axis of rotation, wherein at least two separate ribs are configured on the rotation shaft on the first type of building element, and wherein the second type of building element comprises a ratchet mechanism comprising a ratchet housing and a ratchet element configured to engage with a set of ratchet ribs arranged inside ratchet housing, wherein the ratchet element comprises a number of elastic ratchet springs thereon configured, when the ratchet element is rotated in the ratchet housing, to be driven past the set of ratchet ribs, whereby the ratchet springs are successively deformed elastically against the set of ratchet ribs to the effect that a ratchet sound is generated when the two types of building elements are interconnected by means of the snap connection and are rotated relative to each other about the axis of rotation, wherein the ratchet housing comprises a cylindrical dish having the rotation bushing arranged centrally therein, and a separable lid being attachable to the dish so that the lid and the dish forms a closed space around the ratchet housing containing the ratchet element.

2. A toy building set according to claim 1, wherein the first type of building element has an essentially planar surface from where the rotation shaft extends substantially at right angles, and wherein the rotation shaft is configured as a tube, in which tube the ribs are arranged on the inner side.

3. A toy building set according to claim 2, wherein the rotation bushing on the second type of building element comprises a tube which, upon interconnection of the two types of building elements, extends on the outer side of the rotation shaft on the first type of building element, and wherein the ratchet element of the ratchet mechanism is mounted rotatably in the tube on the second type of building element in such a way that the ratchet element is capable of engaging with the ribs on the inner side of the coupling shaft to the effect that the ratchet element is, when the two types of building elements are interconnected by means of the snap connection, forced to rotate along with the first type of building element.

4. A toy building set according to claim 1, further comprising a third type of building element which has a rotation bushing essentially corresponding to the rotation bushing on the second type of building element, but wherein no ratchet mechanism is provided.

5. A toy building set according to claim 1, wherein the ratchet ribs and the ratchet springs are configured within a closed space in the ratchet housing.

* * * * *